US011295684B2

(12) United States Patent
Kang

(10) Patent No.: US 11,295,684 B2
(45) Date of Patent: Apr. 5, 2022

(54) PIXEL DRIVING METHOD, PIXEL DRIVING APPARATUS AND COMPUTER DEVICE

(71) Applicant: HKC CORPORATION LIMITED, Shenzhen (CN)

(72) Inventor: Chih Tsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/272,665

(22) PCT Filed: Dec. 17, 2018

(86) PCT No.: PCT/CN2018/121520
§ 371 (c)(1),
(2) Date: Mar. 2, 2021

(87) PCT Pub. No.: WO2020/103242
PCT Pub. Date: May 28, 2020

(65) Prior Publication Data

US 2021/0193063 A1 Jun. 24, 2021

(30) Foreign Application Priority Data

Nov. 20, 2018 (CN) ..... 201811384528.8

(51) Int. Cl.
*G09G 3/36* (2006.01)

(52) U.S. Cl.
CPC ... *G09G 3/3607* (2013.01); *G09G 2300/0452* (2013.01); *G09G 2320/0242* (2013.01); *G09G 2320/0666* (2013.01)

(58) Field of Classification Search
CPC ..... G09G 3/3607; G09G 2300/0452; G09G 2320/0242; G09G 2320/0666
See application file for complete search history.

(56) References Cited

U.S. PATENT DOCUMENTS

2018/0174535 A1* 6/2018 Chen ..... G09G 3/007

FOREIGN PATENT DOCUMENTS

| | | | |
|---|---|---|---|
| CN | 106683627 | A | 5/2017 |
| CN | 107154240 | A | 9/2017 |
| CN | 107863083 | A | 3/2018 |
| CN | 108133692 | A | 6/2018 |
| KR | 20090007035 | A | 1/2019 |

OTHER PUBLICATIONS

Mengjun Cao, the ISA written comments, Jul. 2019, CN.
Mengjun Cao, the International Search Report, dated Jul. 2019, CN.

* cited by examiner

*Primary Examiner* — Kenneth B Lee, Jr.

(57) ABSTRACT

A pixel driving method is provided. The method includes: acquiring pixel signals of sub-pixels of each color of each unit pixel in a pixel block, where the unit pixel includes a red sub-pixel, a green sub-pixel and a blue sub-pixel; and loading first-type gray-scale signals to a part of same-color sub-pixels in the pixel block and loading second-type gray-scale signals that are not equal to the first-type gray-scale signals to the remaining same-color sub-pixels based on a preset rule according to the pixel signals of the sub-pixels of each color, signal determination intervals and a proportion standard value corresponding to each of the signal determination intervals, thus improving the graininess of the pixel block during display.

16 Claims, 10 Drawing Sheets

| R | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Rave-1

Rave-i

| Rave | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Gave-1

Gave-j

| Gave | GH | GL |
|---|---|---|
| 0 | GH0 | GL0 |
| 1 | GH1 | GL1 |
| 2 | GH2 | GL2 |
| 3 | GH3 | GL3 |
| 4 | GH4 | GL4 |
| 5 | GH5 | GL5 |
| ⋮ | ⋮ | ⋮ |
| 50 | GH50 | GL50 |
| 51 | GH51 | GL51 |
| 52 | GH52 | GL52 |
| ⋮ | ⋮ | ⋮ |
| 253 | GH253 | GL253 |
| 254 | GH254 | GL254 |
| 255 | GH255 | GL255 |

Rave-1

Rave-i

| R' ave | RH' | RL' |
|---|---|---|
| 0 | RH' 0 | RL' 0 |
| 1 | RH' 1 | RL' 1 |
| 2 | RH' 2 | RL' 2 |
| 3 | RH' 3 | RL' 3 |
| 4 | RH' 4 | RL' 4 |
| 5 | RH' 5 | RL' 5 |
| ⋮ | ⋮ | ⋮ |
| 50 | RH' 50 | RL' 50 |
| 51 | RH' 51 | RL' 51 |
| 52 | RH' 52 | RL' 52 |
| ⋮ | ⋮ | ⋮ |
| 243 | RH' 253 | RL' 253 |
| 244 | RH' 254 | RL' 254 |
| 245 | RH' 255 | RL' 255 |

Gave-1

Gave-j

| R' ave | GH' | GL' |
|---|---|---|
| 0 | GH' 0 | GL' 0 |
| 1 | GH' 1 | GL' 1 |
| 2 | GH' 2 | GL' 2 |
| 3 | GH' 3 | GL' 3 |
| 4 | GH' 4 | GL' 4 |
| 5 | GH' 5 | GL' 5 |
| ⋮ | ⋮ | ⋮ |
| 50 | GH' 50 | GL' 50 |
| 51 | GH' 51 | GL' 51 |
| 52 | GH' 52 | GL' 52 |
| ⋮ | ⋮ | ⋮ |
| 253 | GH' 253 | GL' 253 |
| 254 | GH' 254 | GL' 254 |
| 255 | GH' 255 | GL' 255 |

PIXEL DRIVING METHOD, PIXEL DRIVING APPARATUS AND COMPUTER DEVICE

CROSS REFERENCE OF RELATED APPLICATIONS

The present application claims the priority to the Chinese Patent Application No. CN201811384528.8, filed with National Intellectual Property Administration, PRC on Nov. 20, 2018 and entitled "PIXEL DRIVING METHOD, PIXEL DRIVING APPARATUS AND COMPUTER DEVICE", which is incorporated herein by reference in its entirety.

TECHNICAL FIELD

The present application relates to a pixel driving method, a pixel driving apparatus and a computer device.

BACKGROUND

The statements herein merely provide background information related to the present application and do not necessarily constitute the conventional art.

Currently, a Vertical Alignment (VA) liquid crystal technology or an In-Plane Switching (IPS) liquid crystal technology is mostly adopted for a large-sized display panel. The Vertical Alignment (VA) liquid crystal technology has higher production efficiency and lower cost compared with the In-Plane Switching (IPS) liquid crystal technology; however, it has more obvious defects compared with the In-Plane Switching (IPS) liquid crystal technology in optical property, especially when the large-sized display panel needs a larger viewing angle to be displayed in commercial application. As shown in FIG. 1, when the Vertical Alignment (VA) liquid crystal technology is adopted for display driving, the lightness at a large viewing angle is rapidly saturated with a signal (as shown in a curve 2), which causes the quality contrast and color shift at the large viewing angle to be worse than that at a positive viewing angle (as shown in a curve 1, lightness variation with a signal at the positive viewing angle).

Currently, the pixel driving method provided by the example technique may cause the image to have graininess due to the alternation of the bright and dark sub-pixels.

SUMMARY

The purpose of the present application is to provide a pixel driving method, a pixel driving apparatus and a computer device, so as to avoid the graininess in image display, thereby improving display quality.

A pixel driving method includes:

acquiring pixel signals of sub-pixels of each color of each unit pixel in a pixel block, where the unit pixel includes a red sub-pixel, a green sub-pixel and a blue sub-pixel;

acquiring color signals corresponding to the pixel block according to the pixel signals of the sub-pixels of each color; and loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

In one or more embodiments, the color signals corresponding to the pixel block include color signals of each first grouping unit, where the first grouping unit includes two adjacent unit pixels, and no same unit pixel exists in each of the first grouping units; and the step of acquiring color signals corresponding to the pixel block according to the pixel signals of the sub-pixels of each color includes:

acquiring an average pixel signal of sub-pixels of each color in each of the first grouping units in the pixel block; and acquiring the color signals of each first grouping unit according to the average pixel signal of the sub-pixels of each color in each of the first grouping units.

In one or more embodiments, the color signals corresponding to the pixel block include a color signal of each unit sub-pixel, and the step of acquiring color signals corresponding to the pixel block according to the pixel signals of the sub-pixels of each color includes:

acquiring the pixel signals of the sub-pixels of each color of each unit pixel in the pixel block; and acquiring the color signal of each of the unit pixels according to the pixel signals of the sub-pixels of each color of each of the unit pixels.

In one or more embodiments, the signal determination interval includes a red determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals includes:

acquiring first proportion parameters of the color signals corresponding to the pixel block in each signal determination interval;

acquiring the first proportion parameter which is not less than a corresponding proportion standard value, where the corresponding proportion standard value is configured to measuring whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

In one or more embodiments, the signal determination interval includes a green determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals further includes:

if the signal determination interval corresponding to the maximum first proportion parameter meeting the standard proportion requirement is a green determination interval, loading the first-type gray-scale signal and the second-type gray-scale signal respectively to two adjacent green sub-pixels of each first grouping unit in the pixel block; and loading the first-type gray-scale signals to three red sub-pixels of each second grouping unit in the pixel block and loading the second-type gray-scale signal to one red sub-pixel in the second grouping unit.

In one or more embodiments, the step of loading the first-type gray-scale signals to a part of same-color sub-pixels in the pixel block and loading the second-type gray-scale signals to the remaining same-color sub-pixels based on a preset rule further includes:

loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

In one or more embodiments, the signal determination interval includes a blue determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals further includes:

if the signal determination interval corresponding to the maximum first proportion parameter meeting the standard proportion requirement is a blue determination interval, loading first-type gray-scale signals to three red sub-pixels of each second grouping unit in the pixel block, and loading the second-type gray-scale signal to the remaining one red sub-pixel in the second grouping unit; and loading the first-type gray-scale signals to three green sub-pixels of each of the second grouping units in the pixel block and loading the second-type gray-scale signal to the remaining one green sub-pixel in the second grouping unit.

In one or more embodiments, the step of acquiring the first-type gray-scale signals and the second-type gray-scale signals loaded to each second grouping unit includes:

acquiring an average pixel signal of each second grouping unit in the pixel block, where the second grouping unit includes four adjacent unit pixels, and no same unit pixel exists in each of the second grouping units; and acquiring first-type gray-scale signal and second-type gray-scale signal corresponding to the average pixel signal of each second grouping unit by looking up a table.

In one or more embodiments, the step of acquiring the first-type gray-scale signals and the second-type gray-scale signals loaded to each first grouping unit includes:

acquiring an average pixel signal of each of the first grouping units in the pixel block, where the first grouping unit includes two adjacent unit pixels, and no same unit pixel exists in each of the first grouping units; and acquiring the first-type gray-scale signal and the second-type gray-scale signal corresponding to the average pixel signal of each of the first grouping units by looking up a table.

In one or more embodiments, before the step of acquiring pixel signals of sub-pixels of each color of each unit pixel in the pixel block, the method further includes:

loading a group of initial high and initial low gray-scale signals to same-color sub-pixels in a first grouping unit of the pixel block, where the first grouping unit includes two adjacent unit pixels, and no same unit pixel exists in each of the first grouping units.

A pixel driving apparatus includes:

a pixel signal acquisition circuit for acquiring pixel signals of sub-pixels of each color of each unit pixel in a pixel block, where the unit pixel includes a red sub-pixel, a green sub-pixel and a blue sub-pixel;

a color signal acquisition circuit for acquiring color signals corresponding to the pixel block according to the pixel signals of the sub-pixels of each color; and a driving signal loading circuit for loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

A computer device includes a memory having computer-readable instructions stored therein and one or more processors, where the computer-readable instructions, when executed by the one or more processors, cause the one or more processors to perform the steps of:

acquiring pixel signals of sub-pixels of each color of each unit pixel in a pixel block, where the unit pixel includes a red sub-pixel, a green sub-pixel and a blue sub-pixel;

acquiring color signals corresponding to the pixel block according to the pixel signals of the sub-pixels of each color; and loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

In one or more embodiments, the processor, when executing the computer readable instructions, further performs the steps of:

acquiring an average pixel signal of sub-pixels of each color in each first grouping unit in the pixel block; and acquiring the color signals of each first grouping unit according to the average pixel signal of the sub-pixels of each color in each first grouping unit.

In one or more embodiments, the processor, when executing the computer readable instructions, further performs the steps of:

acquiring the pixel signals of the sub-pixels of each color of each unit pixel in the pixel block; and acquiring the color signal of each of the unit pixels according to the pixel signals of the sub-pixels of each color of each of the unit pixels.

In one or more embodiments, the processor, when executing the computer readable instructions, further performs the steps of:

acquiring first proportion parameters of the color signals corresponding to the pixel block in each signal determination interval;

acquiring the first proportion parameter which is not less than a corresponding proportion standard value, where the corresponding proportion standard value is configured to measuring whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can acquire other drawings according to the drawings without, any inventive labor.

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are only for explaining, but not for limiting the present application.

It should be noted that when an element is referred to as being "connected to" another element, it can be directly connected to the other element, or an intervening element may also be present. The terms "mounted", "one end", "the other end" and the like as used herein are for illustration purposes only.

Unless defined otherwise, all technical and scientific terms used herein have the same meaning as commonly understood by one of ordinary skill in the art to which the present application belongs. The term used in the specification of the present application herein is for the purpose of describing particular embodiments only and is not intended to be limiting of the present application. As used herein, the term "and/or" includes any and all combinations of one or more of the associated listed items.

Figure 1:
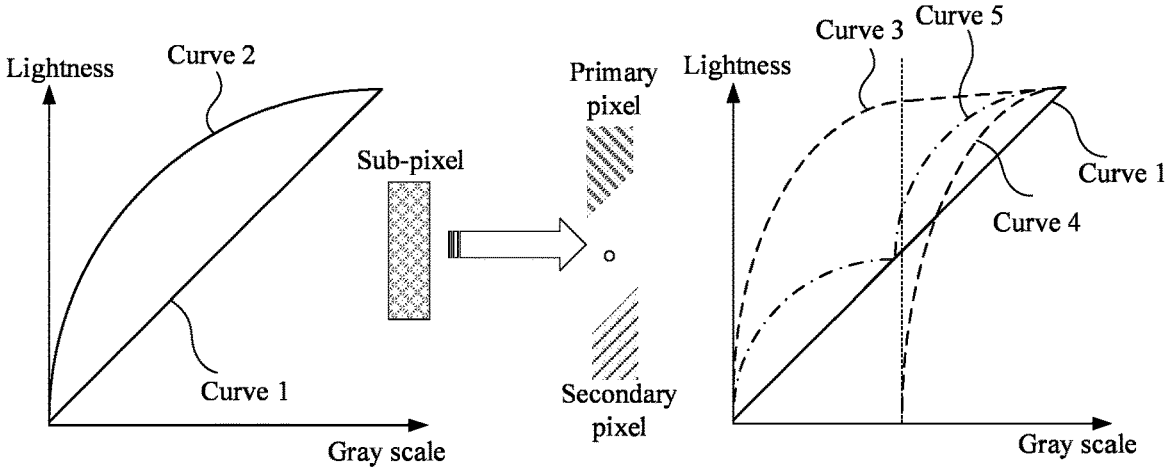
FIG. 1 shows the display lightness of pixels varying with gray-scale signals at a positive viewing angle and a large viewing angle when a VA liquid crystal technology is adopted for display driving.
Figure 2:
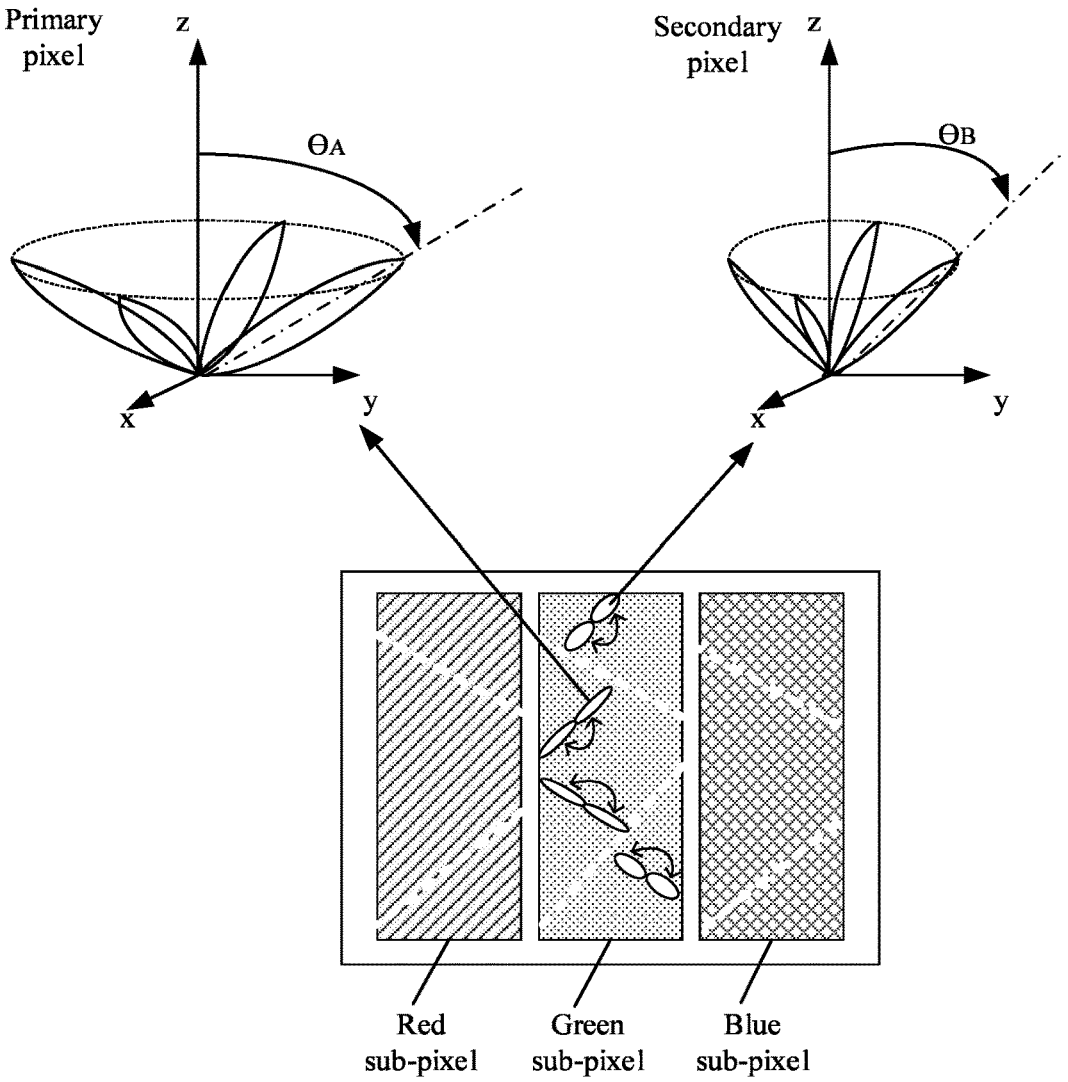
FIG. 2 shows the display lightness of primary pixels and secondary pixels varying with gray-scale signals at the positive viewing angle and the large viewing angle when the primary pixels and the secondary pixels are driven by respectively loading different gray-scale signals.

In an example technique, two adjacent red sub-pixels (green sub-pixels/blue sub-pixels) are divided into a primary pixel and a secondary pixel, and then different gray-scale voltages are applied to the secondary pixel and the secondary pixel, as shown in FIG. 1. When the divided primary pixels and the secondary pixels applied with different gray-scale voltages are driven (curve 3 is the variation of the primary pixels' lightness with signals, and curve 4 is the variation of the secondary pixels' lightness with signals), the curve (curve 5) in which side-view lightness of the display panel composed of the primary pixels and the secondary pixels varies with signals is closer to curve (curve 1) in which positive-view lightness varies with signals, as shown in FIG. 2. Taking green sub-pixels as an example, the defect of the color shift of viewing angle can be solved by spatially designing the primary pixels and secondary pixels and applying different driving signals to them.

Figures 3, 4:
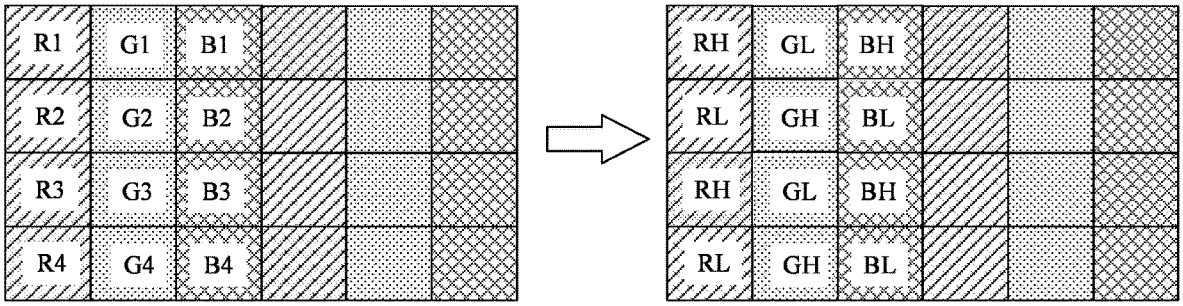
FIG. 3 is a schematic diagram of pixel voltage distribution of the primary pixels and the secondary pixels of a pixel driving method according to an embodiment.
FIG. 4 is a table showing the relationship between the high and low gray-scale signals respectively loaded to the primary pixels and the secondary pixels and the average pixel signal according to an embodiment.

Referring to FIG. 3, for the red sub-pixels, by sacrificing spatial resolution, a group of high and low gray-scale signals RH and RL can be configured to replace original signals R1 and R2 of the sub-pixels, and the combination of the high gray-scale signal and the low gray-scale signal can achieve the effect of improving the color shift of viewing angle. At the positive viewing angle, the average lightness of the group of high and low gray-scale signals RH and RL can maintain the same as that of the original two independent sub-pixel signals R1 and R2. Referring to FIG. 4, taking 8-bit display driver as an example, the gray-scale signal of each sub-pixel is 0, 1, . . . , or 255, the two original independent sub-pixel signals R1, R2 are also gray-scale signals in 0, 1, . . . , 255, the average signal Rave of two adjacent same-color sub-pixels R1, R2 is also a gray-scale signals that is 0, 1, . . . , or 255, and a group of high and low gray-scale signals RH and RL corresponding to the average signal Rave of two adjacent sub-pixels can be found by looking up a table. As shown in FIG. 3, two adjacent same-color sub-pixels are driven to display by high and low gray-scale signals, respectively. In summary of the implementation process of the present applicant, it is found that the above-mentioned manner of driving each sub-pixel by high and low gray-scale signals spatially can improve the color shift of viewing angle. However, due to the alternation of bright and dark sub-pixels, when the lightness difference of the bright and dark sub-pixels is large, the graininess during display is easily occurred, thus the display quality cannot be ensured.

Based on the above, it is desirable to provide a pixel driving method, a pixel driving apparatus, a computer device, and a computer-readable storage medium for solving a problem of the graininess in image display.

Figure 5:
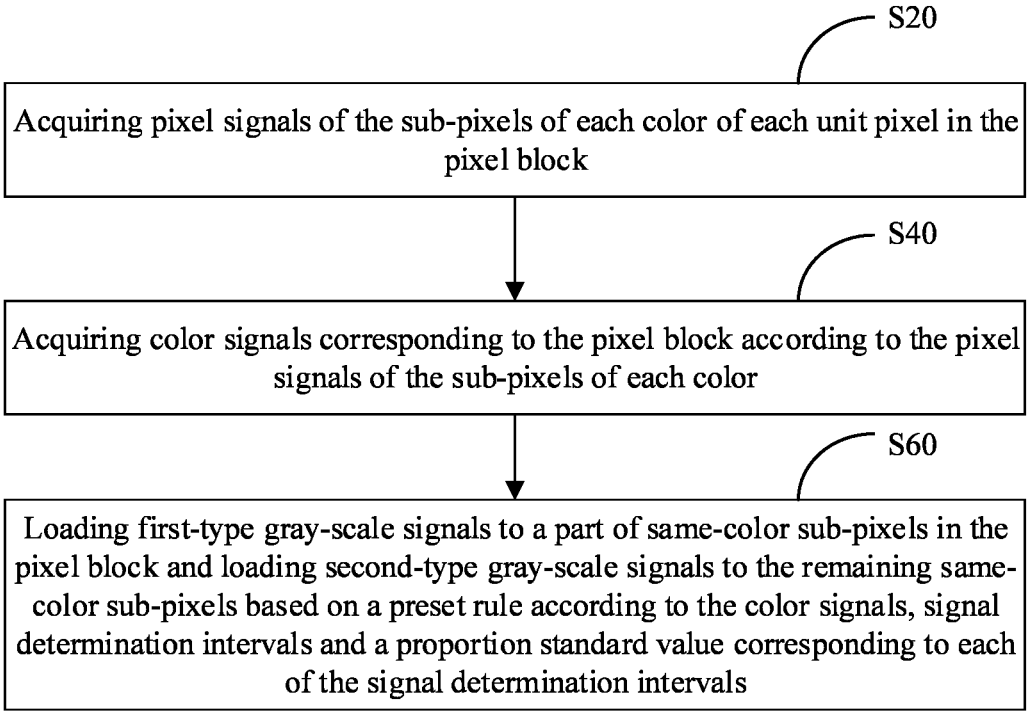
FIG. 5 is a flow schematic diagram of a pixel driving method according to an embodiment.
Figures 6, 7:
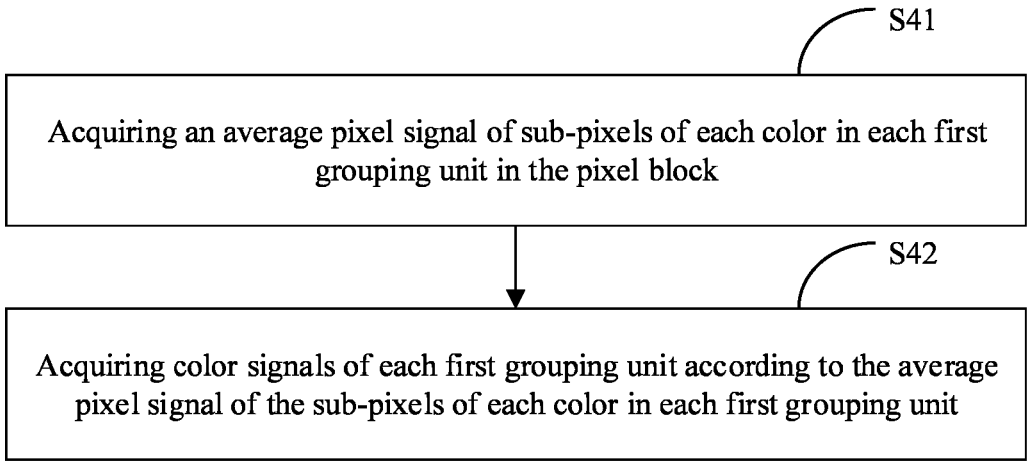
FIG. 6 is a table showing the relationship between a first-type gray-scale signal and a second-type gray-scale signal corresponding to each average pixel signal according to an embodiment.
FIG. 7 is a flow schematic diagram of the step of acquiring color signals corresponding to the pixel block according to the pixel signals of the sub-pixels of each color according to an embodiment.

In one aspect, as shown in FIG. 5, the embodiment of the present application provides a pixel driving method, and the method includes:

S20: acquiring pixel signals of sub-pixels of each color of each unit pixel in a pixel block, where the unit pixel includes a red sub-pixel, a green sub-pixel and a blue sub-pixel;

S40: acquiring color signals corresponding to the pixel block according to the pixel signals of the sub-pixels of each color; and S60: loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals, where the pixel block may be a block including a plurality of unit pixels, for example, a pixel block may be a block including n*m unit pixels. The unit pixel includes a red sub-pixel, a green sub-pixel and a blue sub-pixel. The signal determination interval is a color development interval range for determining which color a color signal belongs to. The preset rule is a rule preset by experience such as experiments and configured to direct the adjustment of the difference value of the first-type gray-scale signals and the second-type gray-scale signals loaded to the same-color sub-pixels in each unit pixel and the adjustment of the proportion of the sub-pixels loaded with the first-type gray-scale signals and the second-type gray-scale signals in the pixel block so as to weaken the graininess when the pixel block is displayed. As shown in FIG. 6, the first-type gray-scale signals and the second-type gray-scale signals are set correspondingly, that is, each first-type gray-scale signal corresponds to a second-type gray-scale signal, and the value of the first-type gray-scale signal is not equal to that of the corresponding second-type gray-scale signal. Optionally, the average signal of the sub-pixel of each color corresponds to a group of first-type and second-type gray-scale signals.

When a display panel composed of multi-color sub-pixels is displayed, the color that each pixel block deflects to is also different due to different loaded pixel voltages. Due to different color-deflection degree, the sensitivity of human eyes to the graininess caused by the difference of high and low gray-scale signals when the sub-pixels of each color in each pixel block are displayed is also different. Therefore, firstly, the pixel signals of the sub-pixels of each color of each unit pixel in the pixel block are acquired, then the color signals corresponding to the pixel block are acquired according to the pixel signals of the sub-pixels of each color, then a color that the pixel block deflects to during display is determined according to proportions of the color signals in each signal determination interval and relationship between each proportion and the corresponding proportion standard value, and lastly loading the first-type gray-scale signals to a part of same-color sub-pixels in the pixel block and loading the second-type gray-scale signals to the remaining same-color sub-pixels based on a preset rule according to the color that is deflected to. The part of the same-color sub-pixels and the remaining same-color sub-pixels referred to herein refer to sub-pixels with the same color. The rule for loading the gray-scale signals is for the same-color sub-pixels in the unit pixel.

In one or more embodiments, as shown in FIG. 7, the color signals corresponding to the pixel block include color signals of each first grouping unit, where the first grouping unit includes two adjacent unit pixels, and no same unit pixel exists in each of the first grouping units;

the step of acquiring color signals corresponding to the pixel block according to the pixel signals of the sub-pixels of each color includes:

S41: acquiring an average pixel signal of sub-pixels of each color in each first grouping unit in the pixel block; and S42: acquiring the color signals of each of the first grouping units according to the average pixel signal of the sub-pixels of each color in each of the first grouping units.

Figure 8:
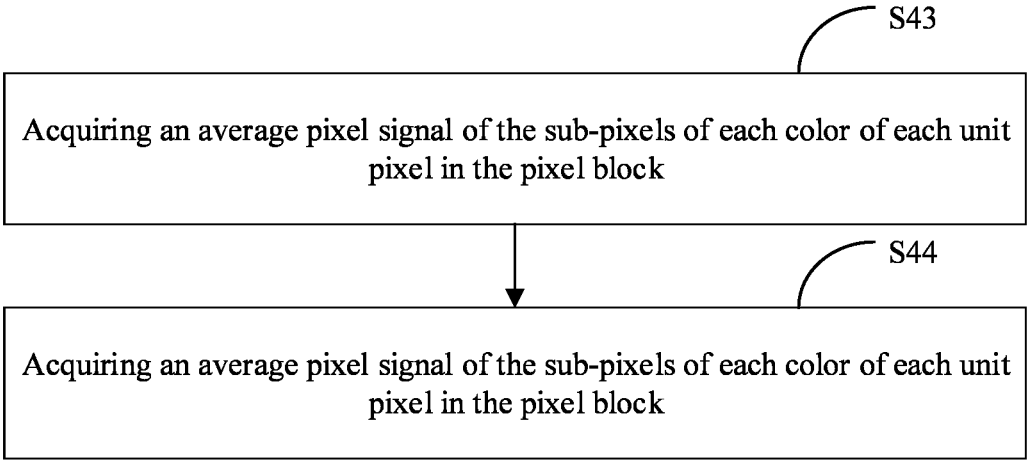
FIG. 8 is a flow schematic diagram of the step of acquiring color signals corresponding to the pixel block according to the pixel signals of the sub-pixels of each color according to an embodiment.

In one or more embodiments, as shown in FIG. 8, the color signals corresponding to the pixel block include a color signal of each unit sub-pixel, and the step of acquiring color signals corresponding to the pixel block according to the pixel signals of the sub-pixels of each color includes:

S43: acquiring the pixel signals of the sub-pixels of each color of each of the unit pixels in the pixel block; and S44: acquiring the color signal of each of the unit pixels according to the pixel signals of the sub-pixels of each color of each of the unit pixels.

Figure 9:
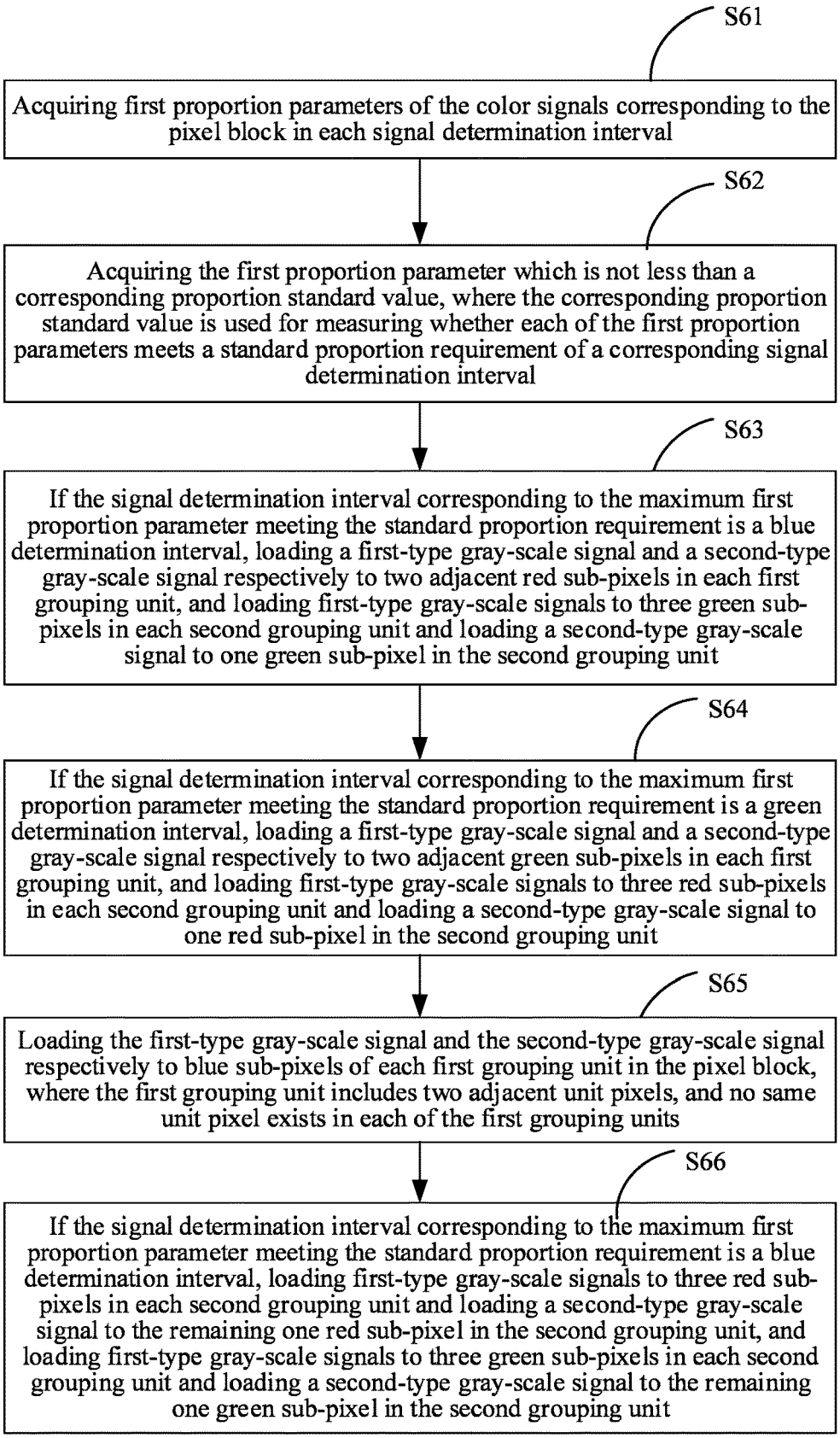
FIG. 9 is a flow schematic diagram of the step of loading the first-type gray-scale signals to a part of same-color sub-pixels in the pixel block and loading the second-type gray-scale signals to the remaining same-color sub-pixels based on a preset rule according to another embodiment.

In one or more embodiments, as shown in FIG. 9, the signal determination interval includes a red determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals includes:

S61: acquiring first proportion parameters of the color signals corresponding to the pixel block in each of the signal determination intervals;

S62: acquiring the first proportion parameter which is not less than a corresponding proportion standard value, where the corresponding proportion standard value is configured to measuring whether each of the first proportion parameters meets a standard proportion requirement of a corresponding signal determination interval;

S63: if the signal determination interval corresponding to the maximum first proportion parameter meeting the standard proportion requirement is a red determination interval, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

According to the Commission Internationale de L' Eclairage (CIE) specifications, L (brightness), C (purity) and H (hue) are functions with respect to R, G, B three-color space coordinates in the color coordinate system, where L=fl(R, G, B), C=fl(R, G, B), and H=fl(R, G, B), respectively. Referring to FIG. 8, where H is color representative, which represents different hue colors with 0° to 360° where 0° is defined as red, 90° as yellow, 180° as green, and 270° as blue. C is color purity, which represents chroma. The range of C is 0 to 100, where 100 represents the brighter color and the value of C, to some extent, represents the display of high and low gray-scale signals on the LCD. The corresponding LCH values can be acquired by acquiring the pixel signals of the red sub-pixels, the pixel signals of the green sub-pixels, and the pixel signals of the blue sub-pixels.

Specifically, in this embodiment, average pixel signal R of two adjacent red sub-pixels, average pixel signal G of two adjacent green sub-pixels, and average pixel signal B of two adjacent blue sub-pixels of k first grouping units in the pixel block are acquired by acquiring pixel signals of the sub-pixels of each color, and according to the acquired average pixel signals of sub-pixels of each color, k color signals corresponding to the pixel block can be acquired. And then the maximum first proportion parameter in first proportion parameters of color signals in each signal determination interval that meets the standard value requirement is acquired. If the signal determination interval corresponding to the first proportion parameter is a red determination interval, it is indicated that the average color signal of the pixel block is deflected to red during display, and thus for most of the red sub-pixels of the pixel block, 2 adjacent red sub-pixel signals of each first grouping unit in the interval can be averaged, and the first-type gray-scale signal and the second-type gray-scale signal corresponding to the average pixel signal can be acquired by looking up a table to drive the two adjacent red sub-pixels respectively according to FIG. 6 and FIG. 10. For the green sub-pixels, 4 adjacent green sub-pixel signals of the second grouping unit in the interval can be averaged to acquire the first-type gray-scale signals GH' and one second-type gray-scale signal GL' corresponding to the average pixel signal, and then the first-type gray-scale signals GH' can be loaded to three green sub-pixels in the second grouping unit, and the second-type gray-scale signal GL' can be loaded to the remaining one green sub-pixel according to FIG. 10 and FIG. 11. It should be noted that the first-type gray-scale signals and the second-type gray-scale signals may be acquired by looking up a preset table, where the first-type gray-scale signals may be high gray-scale signals relative to the second-type gray-scale signals, or may be medium-low gray-scale signals relative to the second-type gray-scale signals, or may be low gray-scale signals relative to the second-type gray-scale signals.

Similarly, when the color signals corresponding to the pixel block include the color signal of each unit pixel, rein red sub-pixels and n*m green sub-pixels are acquired for the pixel block composed of n*m unit pixels. n*m red sub-pixels R1,1, R2,1, R3,1, R4,1, . . . , and Rn, m and n*m green sub-pixels G1,1, G2,1, G3,1, G4,1, . . . , and Gn,m in a pixel block are converted into n*m color signals L1,1, L1,2, L1,3, . . . , and Ln, m, C1,1, C1,2, C1,3, . . . , Cn, m and H1,1, H1,2, H1,3, . . . , and Hn,m, respectively. The proportions of the n*m unit pixel signals converted into the color signals in each signal determination intervals are counted, and the proportions of the n*m color signals in each signal determination intervals are X1%, X2%, . . . X6% . . . , respectively. For example, if, according to counting, the hue angle Hn,m of the n*m color signals is within hue ranges of 0°<Hn,m≤45° and 315°<Hn,m≤360°, the chroma Cn,m is within a range of CTL1≤Cn,m≤CTH2 (CTL1 and CTH2 are predefined chroma ranges), and the proportion of being in the signal determination interval is X1%, where Xth1≤X1%, and X1%>X2%, X3%, X4% . . . X6%, it is easy to conclude that the average color signal of the pixel block is deflected to red. For most of the red sub-pixels of the pixel block, 2 adjacent red sub-pixel signals of each first grouping unit in the interval can be averaged, and the first-type gray-scale signal and the second-type gray-scale signal corresponding to the average pixel signal can be acquired by looking up a table to drive the two adjacent red sub-pixels respectively according to FIG. 6 and FIG. 10. For the green sub-pixels, 4 adjacent green sub-pixel signals of the second grouping unit in the interval can be averaged to acquire the first-type gray-scale signals GH' and one second-type gray-scale signal GL' corresponding to the average pixel signal, and then the first-type gray-scale signals GH' can be loaded to three green sub-pixels in the second grouping unit, and the second-type gray-scale signal GL' can be loaded to the remaining one green sub-pixel according to FIG. 10 and FIG. 11. It should be noted that the first-type gray-scale signals and the second-type gray-scale signals may be acquired by looking up a preset table, where the first-type gray-scale signals may be high gray-scale signals relative to the second-type gray-scale signals, or may be medium-low gray-scale signals relative to the second-type gray-scale signals, or may be low gray-scale signals relative to the second-type gray-scale signals.

In one or more embodiments, as shown in FIG. 9, the signal determination interval includes a green determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals further includes:

S64: if the signal determination interval corresponding to the maximum first proportion parameter meeting the standard proportion requirement is a green determination interval, loading the first-type gray-scale signal and the second-type gray-scale signal respectively to two adjacent green sub-pixels of each first grouping unit in the pixel block; and loading the first-type gray-scale signals to three red sub-pixels of each second grouping unit in the pixel block and loading the second-type gray-scale signal to one red sub-pixel in the second grouping unit.

Figures 10, 11:
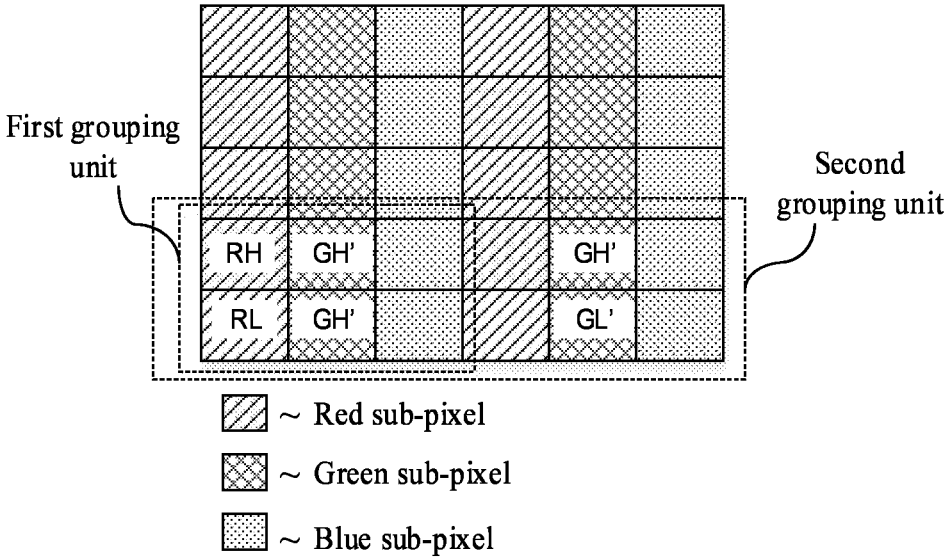
FIG. 10 is a schematic diagram of gray-scale voltage distribution of sub-pixels and grouping units according to an embodiment.
FIG. 11 is a table showing the relationship between the first-type gray-scale signal and the second-type gray-scale signal corresponding to each average pixel signal according to yet another embodiment.
Figure 12:
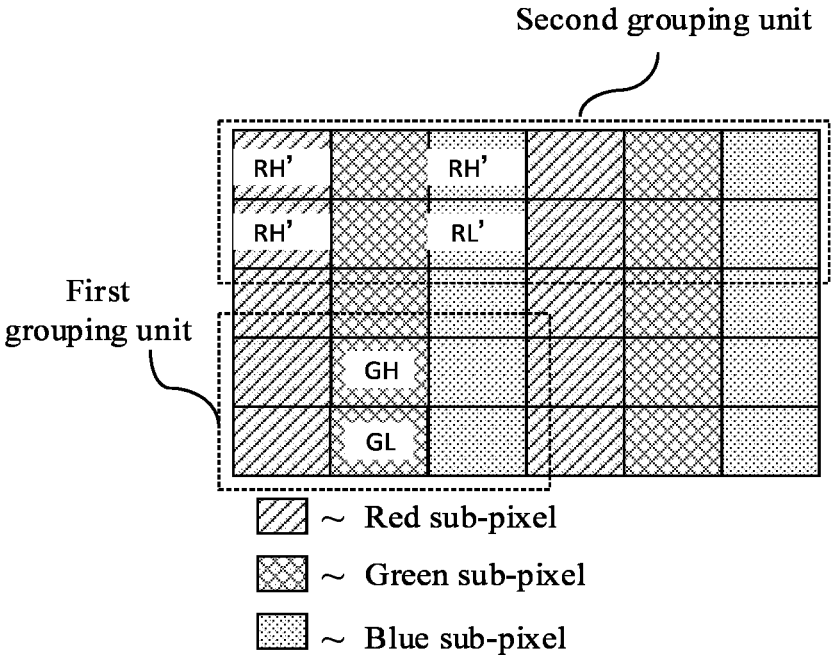
FIG. 12 is a schematic diagram of gray-scale voltage distribution of sub pixels and grouping units according to still another embodiment.

If the color signal meets the green-rendering condition, it is indicated that for most of the green sub-pixels of the pixel block, 2 adjacent green sub-pixel signals of each first grouping unit in the interval can be averaged, and the first-type gray-scale signal GH and the second-type gray-scale signal GL corresponding to the averaged pixel signal can be acquired by looking up a table to drive the two adjacent green sub-pixels respectively according to FIG. 6 and FIG. 10. For the red sub-pixels, 4 adjacent red sub-pixel signals of the second grouping unit in the interval can be averaged to acquire the first-type gray-scale signals RH' and one second-type gray-scale signal RL' corresponding to the average pixel signal, and then the first-type gray-scale signals RH' can be loaded to three red sub-pixels in the second grouping unit, and the second-type gray-scale signal RL' can be loaded to the remaining one red sub-pixel according to FIG. 11 and FIG. 12. It should be noted that the first-type gray-scale signals and the second-type gray-scale signals may be acquired by looking up a preset table, where the first-type gray-scale signals may be high gray-scale signals relative to the second-type gray-scale signals, or may be medium-low gray-scale signals relative to the second-type gray-scale signals, or may be low gray-scale signals relative to the second-type gray-scale signals.

In one or more embodiments, as shown in FIG. 9, the step of loading the first-type gray-scale signals to a part of same-color sub-pixels in the pixel block and loading the second-type gray-scale signals to the remaining same-color sub-pixels based on a preset rule further includes:

S65: loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

Because human eyes have low sensitivity to the variation of blue color lightness and to the difference of lightness of blue sub-pixels, for the driving signals of the blue sub-pixels, a group of first-type and second-type gray-scale signals corresponding to the average pixel signal of every two adjacent blue sub-pixels can be configured to respectively replace the pixel signals B1 and B2 originally loaded to the two adjacent blue sub-pixels, the combination of the first-type gray-scale signal and the second-type gray-scale signal can achieve the effect of improving the color shift of viewing angle, and at the positive viewing angle, the average lightness of the group of first-type and second-type gray-scale signals can maintain the same as that of the original two independent sub-pixel signals B1 and B2. Optionally, for the blue sub-pixels, the original two independent blue sub-pixel signals B1 and B2 may also be maintained.

In one or more embodiments, as shown in FIG. 9, the signal determination interval includes a blue determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals further includes:

S66: if the signal determination interval corresponding to the maximum first proportion parameter meeting the standard proportion requirement is a blue determination interval, loading the first-type gray-scale signals to three red sub-pixels of each second grouping unit in the pixel block, and loading the second-type gray-scale signal to the remaining one red sub-pixel in the second grouping unit; and loading the first-type gray-scale signals to three green sub-pixels of each of the second grouping units in the pixel block and loading the second-type gray-scale signal to the remaining one green sub-pixel in the second grouping unit.

If the color signal meets the blue-rendering condition, it is indicated that the average color signal of the pixel block is deflected to blue, and thus for most of red sub-pixels of the pixel block the first-type gray-scale signal and the second-type gray-scale signal corresponding to the average pixel signal of every 4 adjacent red sub-pixels of each second grouping unit in the interval can be acquired, where the first-type gray-scale signal (high-voltage gray-scale signal RH') is loaded to 3 red sub-pixels, and the second-type gray-scale signal (low-voltage gray-scale signal RL') is loaded to the remaining one red sub-pixel according to FIG. 11. Similarly, for the green sub-pixels, the first-type gray-scale signal and the second-type gray-scale signal may also be acquired, the first-type gray-scale signals may be loaded to three of the four green sub-pixels, and the second-type gray-scale signal may be loaded to the remaining one green sub-pixel according to FIG. 11.

Figure 13:
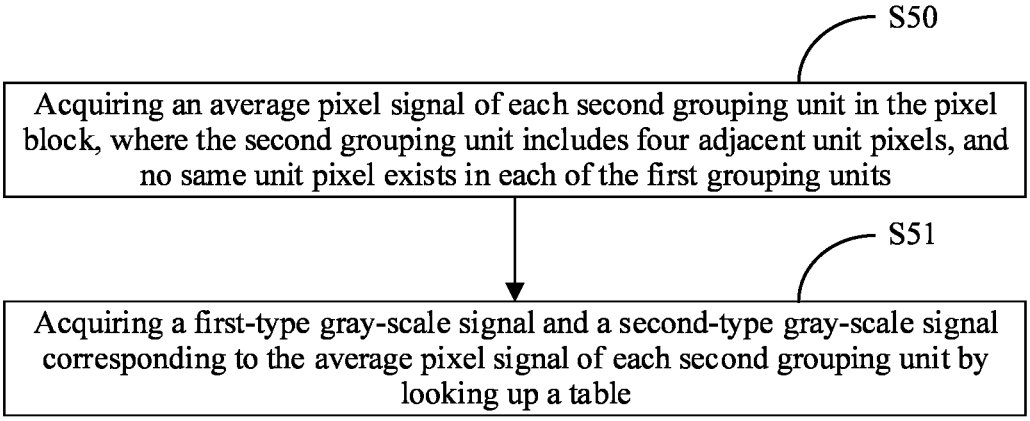
FIG. 13 is a flow schematic diagram of the step of acquiring the first-type gray-scale signals and the second-type gray-scale signals loaded to each second grouping unit according to an embodiment.

In one or more embodiments, as shown in FIG. 13, the step of acquiring the first-type gray-scale signals and the second-type gray-scale signals loaded to each second grouping unit includes:

S50: acquiring an average pixel signal of each of the second grouping units in the pixel block, where the second grouping unit includes four adjacent unit pixels, and no same unit pixel exists in each of the second grouping units; and S51: acquiring the first-type gray-scale signals and the second-type gray-scale signals corresponding to the average pixel signal of each of the second grouping units by looking up a table.

Figure 14:
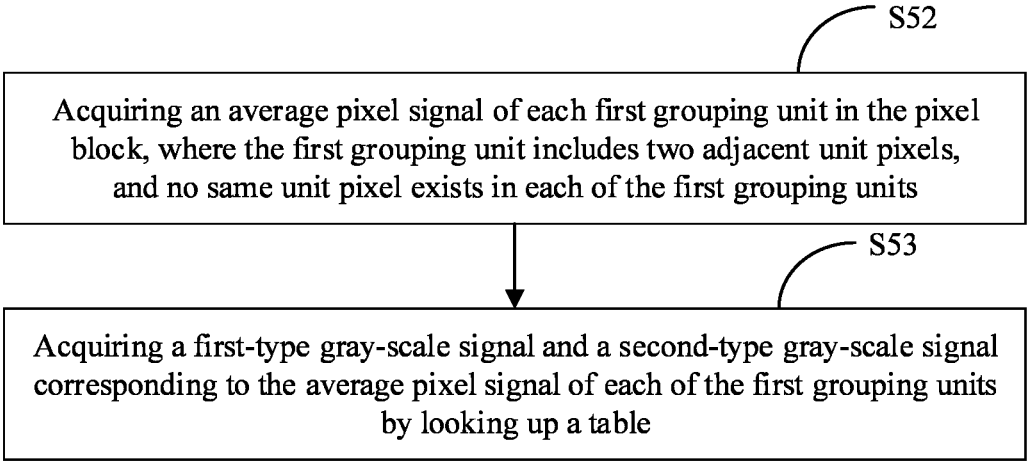
FIG. 14 is a flow schematic diagram of the step of acquiring the first-type gray-scale signals and the second-type gray-scale signals loaded to each first grouping unit according to yet another embodiment.

In one or more embodiments, as shown in FIG. 14, the step of acquiring the first-type gray-scale signals and the second-type gray-scale signals loaded to each first grouping unit includes:

S52: acquiring an average pixel signal of each of the first grouping units in the pixel block, where the first grouping unit includes two adjacent unit pixels, and no same unit pixel exists in each of the first grouping units; and S53: acquiring the first-type gray-scale signal and the second-type gray-scale signal corresponding to the average pixel signal of each of the first grouping units by looking up a table.

Figure 15:
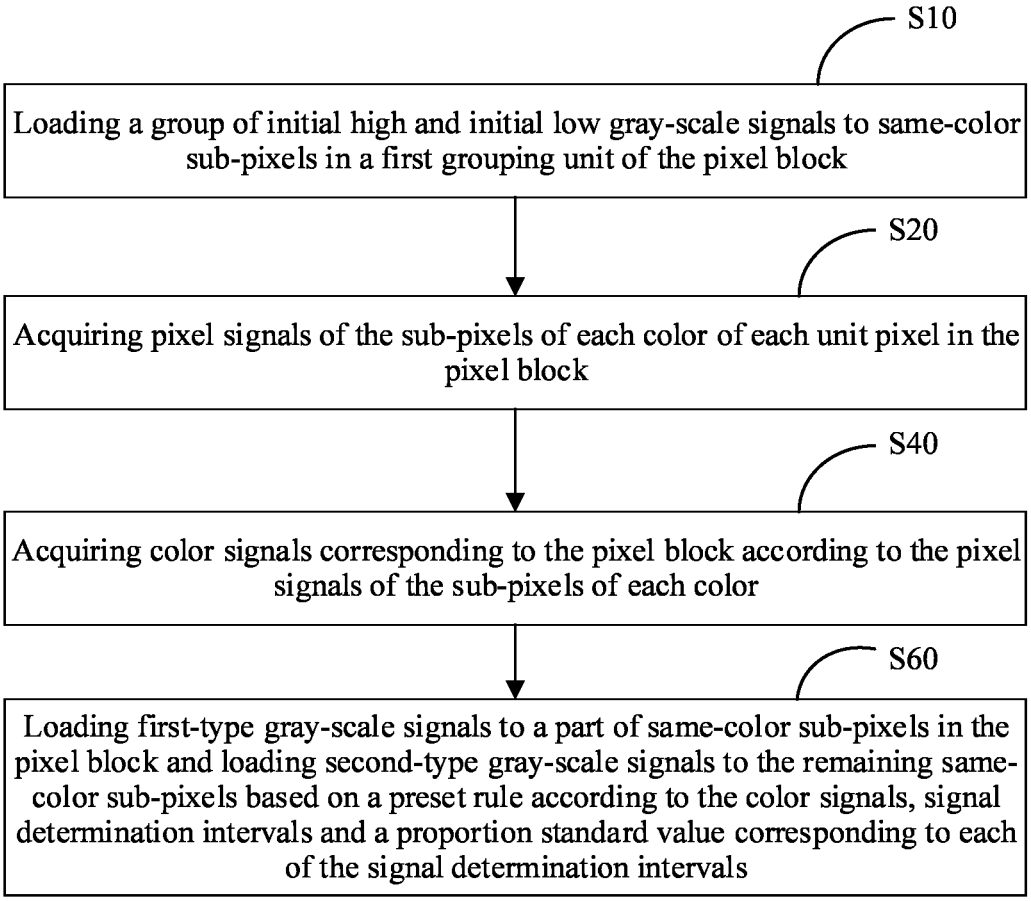
FIG. 15 is a flow schematic diagram of a pixel driving method according to yet another embodiment.

In one or more embodiments, as shown in FIG. 15, before the step of acquiring pixel signals of sub-pixels of each color of each unit pixel in the pixel block, the method further includes:

S10: loading a group of initial high and initial low gray-scale signals to same-color sub-pixels in a first grouping unit of the pixel block, where the first grouping unit includes two adjacent unit pixels, and no same unit pixel exists in each of the first grouping units.

In order to ensure the large-viewing-angle display effect when the pixel block is displayed, a group of initial high and initial low gray-scale signals are loaded to every two adjacent unit pixels during initialization. And then whether the pixel block has graininess during display is determined. If so, a group of first-type and second-type gray-scale signals corresponding to the average pixel signal of every four adjacent same-color sub-pixels are acquired, and the first-type gray-scale signals and the second-type gray-scale signals are loaded to each unit pixel according to a preset rule. If not, a group of first-type and second-type gray-scale signals corresponding to the average pixel signal of every two adjacent sub-pixels can be configured to replace the original initial high gray-scale signal and the initial low gray-scale signal. Or if not, the original initial high gray-scale signal and the initial low gray-scale signal can be remained unchanged, where the initial high gray-scale signal and the initial low gray-scale signal can be acquired by looking up a table. It should be noted that the loading of the initial high gray-scale signal and the initial low gray-scale signal herein are both for the same-color sub-pixels in two adjacent unit pixels.

In one or more embodiments, the color signal includes chroma and hue angle, and under a red rendering interval, the chroma and the hue angle satisfy the following conditions respectively:

$$0° < H \leq 45° \text{ or } 315° < H \leq 360°, \text{ and } CTL1 \leq C \leq CTH2,$$

where H is chroma, C is hue angle, CTL1 is a lowest predefined red hue threshold, and CTH2 is a highest predefined red hue threshold.

It should be understood that although the various steps of the flow diagram in FIG. 15 are shown in order as indicated by arrows, the steps are not necessarily performed in order as indicated by the arrows. The steps are not limited to being performed in the exact order illustrated and, unless explicitly stated herein, may be performed in other orders. Moreover, at least some of the steps in FIG. 15 may include multiple sub-steps or multiple stages that are not necessarily performed at the same time but may be performed at different times, and the sub-steps or stages are not necessarily performed sequentially but may be performed in turn or alternately with other steps or at least some of the sub-steps or stages of other steps.

Figure 16:
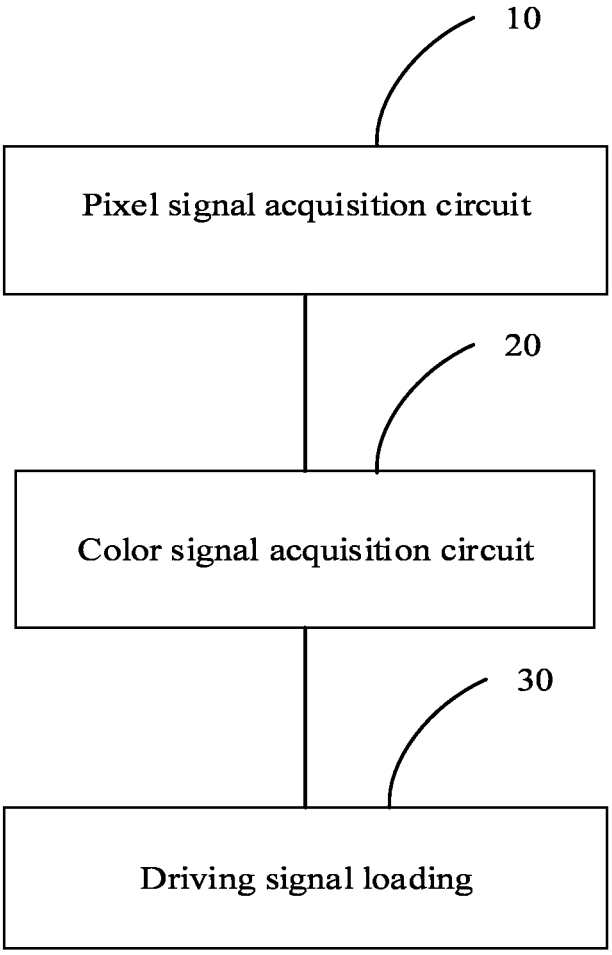
FIG. 16 is a structural schematic diagram of a pixel driving apparatus according to an embodiment.

A pixel driving apparatus, as shown in FIG. 16, includes:

a pixel signal acquisition circuit 10 for acquiring pixel signals of sub-pixels of each color of each unit pixel in a pixel block, where the unit pixel includes a red sub-pixel, a green sub-pixel and a blue sub-pixel;

a color signal acquisition circuit 20 for acquiring color signals corresponding to the pixel block according to the pixel signals of the sub-pixels of each color; and a driving signal loading circuit 30 for loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

The definitions of the pixel block, the unit pixel, etc. are the same as those in the above embodiments, and are not repeated herein. Specifically, the pixel signal acquisition circuit 10 acquires pixel signals of sub-pixels of each color of each unit pixel in a pixel block, and sends the pixel signals to the color signal acquisition circuit 20, where the unit pixel includes a red sub-pixel, a green sub-pixel and a blue sub-pixel, then the color signal acquisition circuit 20 acquires color signals corresponding to the pixel block according to the pixel signals of the sub-pixels of each color, and then the driving signal loading circuit 30 loads first-type gray-scale signals to a part of same-color sub-pixels in the pixel block and loads second-type gray-scale signals to the remaining same-color sub-pixels based on a preset rule according to the color signals, signal determination intervals and a proportion standard value corresponding to each of the signal determination intervals, so that the graininess of the display panel formed by each pixel block during display is weakened and the display quality is improved.

Moreover, the definition of the pixel driving method above can be referred to for the specific definition of the pixel driving apparatus, which thereby will not be described herein again. The modules in the pixel driving apparatus above can be wholly or partially implemented by software, hardware and a combination thereof. The above modules can be embedded in a hardware form or independent of a processor in the computer device, and can also be stored in a memory in the computer device in a software form, so that the processor can call and execute operations corresponding to the modules.

Figure 17:
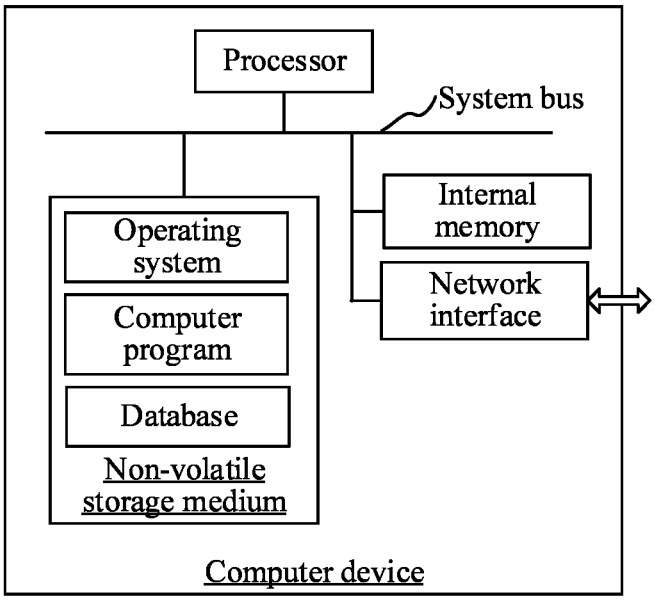
FIG. 17 is a diagram of an internal structure of a computer device according to an embodiment.

In one or more embodiments, a computer device is provided, which may be a server, and the internal structure diagram thereof may be as shown in FIG. 17. The computer device includes a processor, a memory, a network interface, and a database connected by a system bus. The processor of the computer device is configured to provide computing and controlling capabilities. The memory of the computer device includes a non-volatile storage medium and an internal memory. The non-volatile storage medium stores an operating system, a computer program, and a database. The internal memory provides an environment for the operation of the operating system and the computer program in the non-volatile storage medium. The database of the computer device is configured to store data such as a signal determination interval, a first-type gray-scale signal and a second-type gray-scale signal. The network interface of the computer device is configured to communicate with an external terminal through a network connection. The computer program is executed by the processor to implement a pixel driving method.

It will be understood by those skilled in the art that the structure shown in FIG. 17 is only a block diagram of part of structure associated with the present application, and is not intended to limit the computer device to which the present application may be applied, and that a specific computer device may include more or fewer components than shown in the FIG. 17, or may combine certain components, or have a different arrangement of components.

A computer device, as shown in FIG. 17, includes a memory and a processor, where the memory stores a computer program, and the processor, when executing the computer program, implements the steps of:

S20: acquiring pixel signals of sub-pixels of each color of each unit pixel in a pixel block, where the unit pixel includes a red sub-pixel, a green sub-pixel and a blue sub-pixel;

S40: acquiring color signals corresponding to the pixel block according to the pixel signals of the sub-pixels of each color; and S60: loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

When the computer device provided by the embodiment of the application operates, the main color of each pixel block during display can be determined according to the pixel signals of the sub-pixels of the pixel block, and then the first-type gray-scale signals and the second-type gray-scale signals are loaded to each unit pixel of the pixel block according to the pre-stored preset rule, so that the graininess of the pixel block during display is reduced, and the display quality is improved.

A computer-readable storage medium has a computer program stored thereon, and the computer program, when executed by a processor, implements the steps of:

S20: acquiring pixel signals of sub-pixels of each color of each unit pixel in a pixel block, where the unit pixel includes a red sub-pixel, a green sub-pixel and a blue sub-pixel;

S40: acquiring color signals corresponding to the pixel block according to the pixel signals of the sub-pixels of each color; and S60: loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, where the first-type gray-scale signals are not equal to the corresponding second-type gray-scale signals.

It will be understood by those skilled in the art that all or part of the processes of the method of the embodiments described above may be implemented by instructing relevant hardware through a computer program, which may be stored in a non-volatile computer-readable storage medium, and when executed, may include the processes of the method of the embodiments described above. Any reference to memory, storage, database or other medium used in the embodiments provided herein can include non-volatile and/or volatile memory. The non-volatile memory can include Read-Only Memory (ROM), Programmable ROM (PROM), Electrically Programmable ROM (EPROM), Electrically Erasable Programmable ROM (EEPROM), or flash memory. The volatile memory can include Random Access Memory (RAM) or external cache memory. By way of illustration rather than limitation, RAM is available in a variety of forms such as Static RAM (SRAM), Dynamic RAM (DRAM), Synchronous DRAM (SDRAM), Double Data Rate SDRAM (DDRSDRAM), Enhanced SDRAM (ESDRAM), Synchronous Link (Synchlink), Synchronous Link DRAM (SLDRAM), Rambus Direct RAM (RDRAM), Direct Rambus Dynamic RAM (DRDRAM), and Rambus Dynamic RAM (RDRAM).

The technical features of the above embodiments can be combined arbitrarily. For the sake of brevity, all possible combinations of the technical features of the above embodiments are not described, and such combinations of the technical features shall be deemed to fall within the scope of the present disclosure as long as there is no contradiction.

The embodiments above only describe several implementations of the present application, and the description thereof is specific and detailed. However, those cannot be therefore construed as limiting the scope of the present application. It should be noted that, for those of ordinary skill in the art, several variations and modifications can be made without departing from the concept of the present application, which also fall within the scope of the present application. Therefore, the protection scope of the present application shall be defined by the appended claims.

What is claimed is:

1. A pixel driving method, comprising:

acquiring pixel signals of sub-pixels of each color of each unit pixel in a pixel block, wherein the unit pixel comprises a red sub-pixel, a green sub-pixel and a blue sub-pixel;

acquiring color signals corresponding to the pixel block according to the pixel signals of the sub-pixels of each color; and loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, wherein the first-type gray-scale signals are not equal to the corresponding second-type gray-scale signals;

wherein the color signals corresponding to the pixel block comprise color signals of each first grouping unit, the first grouping unit comprising two adjacent unit pixels and no same unit pixel exists in each of the first grouping units, and the step of acquiring color signals corresponding to the pixel block according to the pixel signals of the sub-pixels of each color comprises:

acquiring an average pixel signal of the sub-pixels of each color in each of the first grouping units in the pixel block; and acquiring the color signals of each of the first grouping units according to the average pixel signal of the sub-pixels of each color in each of the first grouping units;

wherein the signal determination interval comprises a red determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals comprises:

acquiring first proportion parameters of the color signals corresponding to the pixel block in each of the signal determination interval;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each of the first grouping unit in the pixel block, wherein the first grouping unit comprises two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

2. A pixel driving method, comprising:

acquiring pixel signals of sub-pixels of each color of each unit pixel in a pixel block, wherein the unit pixel comprises a red sub-pixel, a green sub-pixel and a blue sub-pixel;

acquiring color signals corresponding to the pixel block according to the pixel signals of the sub-pixels of each color; and loading first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, wherein the first-type gray-scale signals are not equal to the corresponding second-type gray-scale signals;

wherein the color signals corresponding to the pixel block comprise a color signal of each unit sub-pixel, and the step of acquiring color signals corresponding to the pixel block according to the pixel signals of the sub-pixels of each color comprises:

acquiring the pixel signals of the sub-pixels of each color of each of the unit pixels in the pixel block; and acquiring the color signal of each of the unit pixels according to the pixel signals of the sub-pixels of each color of each of the unit pixels;

wherein the signal determination interval comprises a red determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals comprises:

acquiring first proportion parameters of the color signals corresponding to the pixel block in each of the signal determination interval;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each of the first grouping unit in the pixel block, wherein the first grouping unit comprises two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

3. The pixel driving method according to claim 1, wherein the signal determination interval comprises a green determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination interval further comprises:

if the signal determination interval corresponding to the maximum first proportion parameter meeting the standard proportion requirement is a green determination interval, loading the first-type gray-scale signal and the second-type gray-scale signal respectively to two adjacent green sub-pixels of each of the first grouping units in the pixel block; and loading the first-type gray-scale signals to three red sub-pixels of each of the second grouping units in the pixel block and loading the second-type gray-scale signal to one red sub-pixel in the second grouping unit.

4. The pixel driving method according to claim 2, wherein the signal determination interval comprises a green determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals comprises:

if the signal determination interval corresponding to the maximum first proportion parameter meeting the standard proportion requirement is a green determination interval, loading the first-type gray-scale signal and the second-type gray-scale signal respectively to two adjacent green sub-pixels of each of the first grouping units in the pixel block; and loading the first-type gray-scale signals to three red sub-pixels of each of the second grouping units in the pixel block and loading the second-type gray-scale signal to one red sub-pixel in the second grouping unit.

5. The pixel driving method according to claim 1, wherein the step of loading first-type gray-scale signals to a part of same-color sub-pixels in the pixel block and loading second-type gray-scale signals to the remaining same-color sub-pixels based on a preset rule further comprises:

loading the first-type gray-scale signal and the second-type gray-scale signal respectively to blue sub-pixels of each first grouping unit in the pixel block, wherein the first grouping unit comprises two adjacent unit pixels, and no same unit pixel exists in each of the first grouping units.

6. The pixel driving method according to claim 3, wherein the signal determination interval comprises a blue determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals further comprises:

if the signal determination interval corresponding to the maximum first proportion parameter meeting the standard proportion requirement is a blue determination interval, loading the first-type gray-scale signals to three red sub-pixels of each of the second grouping units in the pixel block, and loading the second-type gray-scale signal to the remaining one red sub-pixel in the second grouping unit; and loading the first-type gray-scale signals to three green sub-pixels of each of the second grouping units in the pixel block and loading the second-type gray-scale signal to the remaining one green sub-pixel in the second grouping unit.

7. The pixel driving method according to claim 4, wherein the signal determination interval comprises a blue determination interval, and the step of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination interval further comprises:

if the signal determination interval corresponding to the maximum first proportion parameter meeting the standard proportion requirement is a blue determination interval, loading the first-type gray-scale signals to three red sub-pixels of each of the second grouping units in the pixel block, and loading the second-type gray-scale signal to the remaining one red sub-pixel in the second grouping unit; and loading the first-type gray-scale signals to three green sub-pixels of each of the second grouping units in the pixel block and loading the second-type gray-scale signal to the remaining one green sub-pixel in the second grouping unit.

8. The pixel driving method according to claim 1, wherein the step of acquiring the first-type gray-scale signals and the second-type gray-scale signals loaded to each of the second grouping units comprises:

acquiring the average pixel signal of each of the second grouping units in the pixel block, wherein the second grouping unit comprises four adjacent unit pixels, and no same unit pixel exists in each of the second grouping units; and acquiring the first-type gray-scale signal and the second-type gray-scale signal corresponding to the average pixel signal of each of the second grouping units by looking up a table.

9. The pixel driving method according to claim 2, wherein the step of acquiring the first-type gray-scale signals and the second-type gray-scale signals loaded to each of the second grouping units comprises:

acquiring the average pixel signal of each of the second grouping units in the pixel block, wherein the second grouping unit comprises four adjacent unit pixels, and no same unit pixel exists in each of the second grouping units; and acquiring the first-type gray-scale signal and the second-type gray-scale signal corresponding to the average pixel signal of each of the second grouping units by looking up a table.

10. The pixel driving method according to claim 1, wherein the step of acquiring the first-type gray-scale signals and the second-type gray-scale signals loaded to each of the first grouping units comprises:

acquiring the average pixel signal of each of the first grouping units in the pixel block, wherein the first grouping unit comprises two adjacent unit pixels, and no same unit pixel exists in each of the first grouping units; and acquiring the first-type gray-scale signal and the second-type gray-scale signal corresponding to the average pixel signal of each of the first grouping units by looking up a table.

11. The pixel driving method according to claim 2, wherein the step of acquiring the first-type gray-scale signals and the second-type gray-scale signals loaded to each of the first grouping units comprises:

acquiring the average pixel signal of each of the first grouping units in the pixel block, wherein the first grouping unit comprises two adjacent unit pixels, and no same unit pixel exists in each of the first grouping units; and acquiring the first-type gray-scale signal and the second-type gray-scale signal corresponding to the average pixel signal of each of the first grouping units by looking up a table.

12. The pixel driving method according to claim 1, wherein before the step of acquiring pixel signals of sub-pixels of each color of each unit pixel in the pixel block, the method further comprises:

loading a group of initial high and initial low gray-scale signals to same-color sub-pixels in a first grouping unit of the pixel block, wherein the first grouping unit comprises two adjacent unit pixels, and no same unit pixel exists in each of the first grouping units.

13. A pixel driving apparatus, comprising:

a pixel signal acquisition circuit configured to acquire pixel signals of sub-pixels of each color of each unit pixel in a pixel block, wherein the unit pixel comprises a red sub-pixel, a green sub-pixel and a blue sub-pixel;

a color signal acquisition circuit configured to acquire color signals corresponding to the pixel block according to the pixel signals of the sub-pixels of each color; and a driving signal loading circuit configured to load first-type gray-scale signals to a part of same-color sub-pixels in the pixel block and loading second-type gray-scale signals to the remaining same-color sub-pixels based on a preset rule according to the color signals, signal determination intervals and a proportion standard value corresponding to each of the signal determination intervals, wherein the first-type gray-scale signals are not equal to the corresponding second-type gray-scale signals;

wherein the color signals corresponding to the pixel block comprise color signals of each first grouping unit, the first grouping unit comprising two adjacent unit pixels and no same unit pixel exists in each of the first grouping units, and the operation of acquiring color signals corresponding to the pixel block according to the pixel signals of the sub-pixels of each color performed by the color signal acquisition circuit comprises:

acquiring an average pixel signal of the sub-pixels of each color in each of the first grouping units in the pixel block; and acquiring the color signals of each of the first grouping units according to the average pixel signal of the sub-pixels of each color in each of the first grouping units;

wherein the signal determination interval comprises a red determination interval, and the operation of loading first-type gray-scale signals to a part of same-color sub-pixels in the pixel block and loading second-type gray-scale signals to the remaining same-color sub-pixels based on a preset rule according to the color signals, signal determination intervals and a standard value corresponding to each of the determination intervals that is performed by the driving signal loading circuit comprises:

acquiring first proportion parameters of the color signals corresponding to the pixel block in each of the signal determination interval;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each of the first grouping unit in the pixel block, wherein the first grouping unit comprises two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

14. A computer device, comprising a non-transitory memory having computer-readable instructions stored therein and one or more processors, wherein the computer-readable instructions, when executed by the one or more processors, cause the one or more processors to perform the operations according to claim 1.

15. A computer device comprising a non-transitory memory having computer-readable instructions stored therein and one or more processors, wherein the computer-readable instructions, when executed by the one or more processors, cause the one or more processors to perform the operations according to claim 2.

16. The computer device of claim 14, wherein the processor, when executing the computer readable instructions, further performs the steps of:

acquiring first proportion parameters of the color signals corresponding to the pixel block in each of the signal determination interval;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to the maximum first proportion parameter meeting the standard proportion requirement is a red determination interval, loading the first-type gray-scale signal and the second-type gray-scale signal respectively to two adjacent red sub-pixels of each of the first grouping unit in the pixel block, wherein the first grouping unit comprises two adjacent unit pixels, and no same unit pixel exists in each of the first grouping units; and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

* * * * *